US005354454A

United States Patent [19]

Savastano et al.

[11] Patent Number: 5,354,454

[45] Date of Patent: Oct. 11, 1994

[54] CONTINUOUS PROCESS FOR DEASPHALTING AND DEMETALLATING A RESIDUE FROM CRUDE OIL DISTILLATION

[75] Inventors: Cesar Savastano, Zelo Buon Persico; Roberto Cimino, Milan; Salvatore Meli, Paullo, all of Italy

[73] Assignee: Eni Chem Synthesis S.p.A., Palermo, Italy

[21] Appl. No.: 49,614

[22] Filed: Apr. 19, 1993

Related U.S. Application Data

[63] Continuation of Ser. No. 851,092, Mar. 13, 1992, abandoned.

[30] Foreign Application Priority Data

Mar. 22, 1991 [IT] Italy ..... 000776 A/91

[51] Int. Cl.[5] ..... C10G 21/00

[52] U.S. Cl. ..... 208/309; 208/45; 208/251 R

[58] Field of Search ..... 208/45, 251 R, 309

[56] References Cited

U.S. PATENT DOCUMENTS

| | | | |
|---|---|---|---|
| 2,587,643 | 3/1952 | Myers | 208/309 |
| 3,003,945 | 10/1961 | Garwin | 208/45 |
| 3,053,750 | 9/1962 | Beuther et al. | 208/309 |
| 4,125,458 | 11/1978 | Bushnel et al. | 208/309 |
| 4,324,651 | 4/1982 | Rollmann et al. | 208/309 |
| 4,452,691 | 6/1984 | Polomski | 208/86 |
| 4,482,453 | 11/1984 | Coombs et al. | 208/309 |
| 4,502,944 | 3/1985 | Nelson | 208/45 |
| 4,618,413 | 10/1986 | Overfield | 208/251 R |
| 4,643,821 | 2/1987 | Overfield | 208/251 R |

FOREIGN PATENT DOCUMENTS 0461694 12/1991 European Pat. Off. .

*Primary Examiner*—Helane Myers
*Assistant Examiner*—Walter D. Griffin
*Attorney, Agent, or Firm*—Rogers & Wells

[57] ABSTRACT

A continuous process for deasphalting and demetallating a residue from crude oil distillation, by means of dimethyl carbonate as extraction solvent, comprises:

mixing a residue from crude oil distillation with a recycled liquid stream containing oil and dimethyl carbonate, in order to produce a homogeneous solution;

cooling said homogeneous solution and separating a refined light, liquid, phase; an extracted middle phase; and a heavy phase containing asphaltenes;

recovering a primary, deasphalted/demetallated oil from said light phase;

partially recycling said middle phase to the mixing step, and recovering a secondary deasphalted oil from the residual fraction;

recovering asphaltenes from said heavy phase.

11 Claims, 1 Drawing Sheet

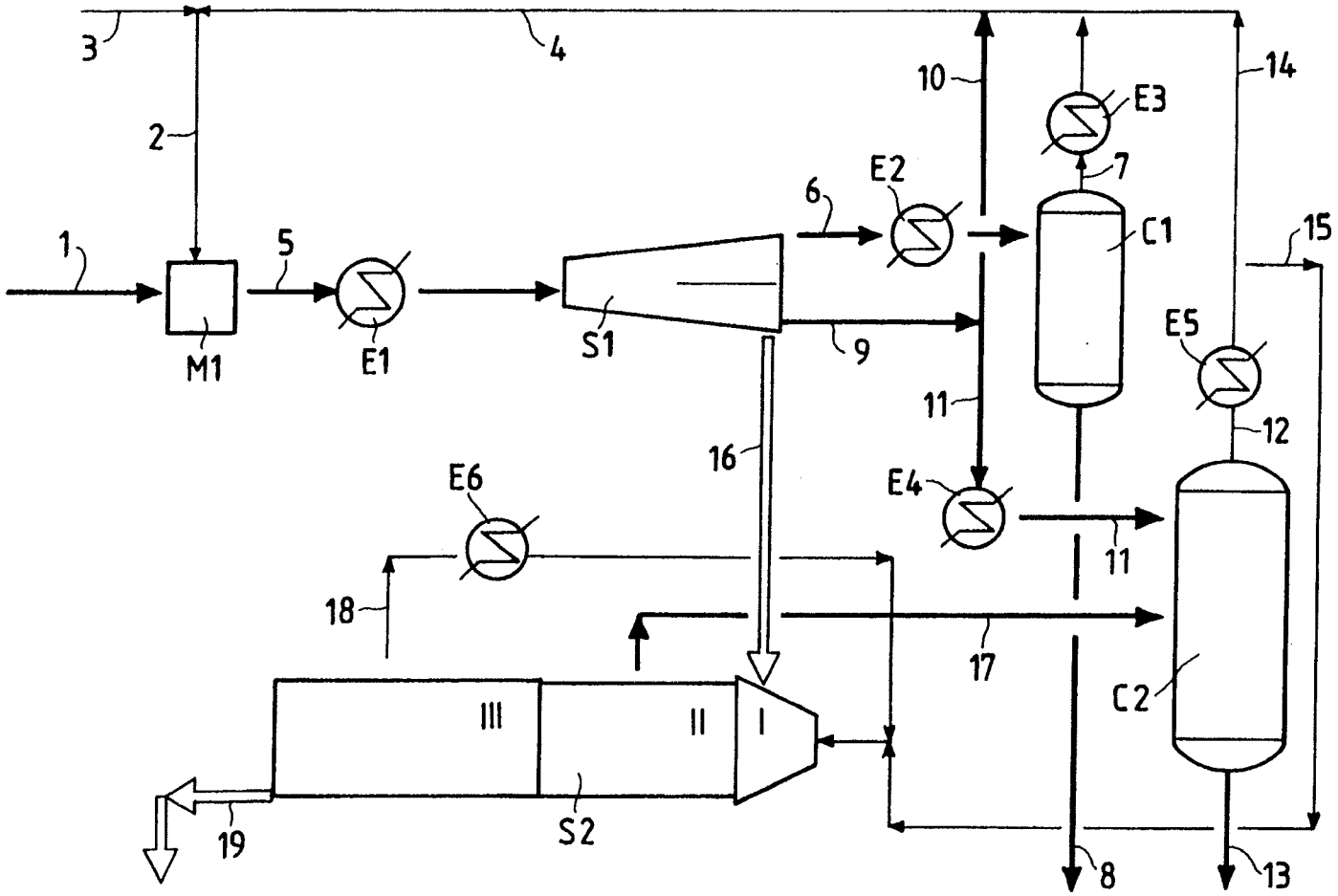
1
2
3
4
5
6
7
8
9
10
11
12
13
14
15
16
17
18
19
M1
E1
E2
E3
E4
E5
E6
S1
S2
C1
C2
I
II
III

CONTINUOUS PROCESS FOR DEASPHALTING AND DEMETALLATING A RESIDUE FROM CRUDE OIL DISTILLATION

This is a continuation application based on, and utilizing the file wrapper and contents of, prior application Ser. No. 07/851,092, filed Mar. 13, 1992, now abandoned.

The present invention relates to a continuous process for removing asphaltenes, metals and heteroatomic compounds from the residues from distillation of crude oil.

The deasphaltation of the residues from crude oil distillation is a treatment used in the art in order to produce two types of products, and namely, base oils for lubricant manufacturing; and additional feedstocks for catalytic cracking, to be blended with the gas oils produced by vacuum fractionation of the residues from atmospheric distillation.

In deasphaltation technique, using hydrocarbonaceous solvents, in particular hydrocarbons of straight-chain paraffin or isoparaffin types, containing from 3 to 7 carbon atoms, is known. Most widely known are those called "Propane Deasphalting" (PDA), "Solvent Deasphalting" (SDA) and "Residual Oil Solvent Extraction" (ROSE).

These processes known in the art make it possible residues (typically, vacuum distillation residues) to be deasphalted with efficiency values of the order of 80%, and to be demetallated with efficiency, values of from 60 to 90%, with a yield of deasphalted oil (DAO) which usually does not exceed 70%.

In the art, the use is described as well of some non-hydrocarbonaceous solvents, endowed with demetallating and/or deasphalting characteristics, such as, e.g., alcohols, aldehydes, esters, ketones and cyclic carbonates, partially mixible with residues from oil processing industry. In particular:

in U.S. Pat. Nos. 4,618,413 and 4,643,821; the use is disclosed of alkylene carbonates as demetallation solvents.

In U.S. Pat. No. 3,003,945; the separation is disclosed of oil processing residues into an asphaltene fraction and an oil fraction, using acetone.

In U.S. Pat. No. 4,125,458; a process is disclosed for deasphalting oil processing residues, which uses hydrocarbonaceous solvents containing phenol or N-methyl-2-pyrrolidone, and a small amount of water.

In U.S. Pat. No. 4,324,651; a process is disclosed for demetallating and deasphalting crude oils, which uses high-temperature methanol; and In U.S. Pat. No. 4,452,691; a process is disclosed for deasphalting heavy oils, using alcohols or ethers.

Unfortunately, none of these processes known from the prior art has been completely satisfactory, because carrying out them is often burdensome, and, above all, they generally do not enable a good deasphaltation of oil processing feedstocks to be reached, together with a simultaneous good separation of both porphirinic and asphaltenic metals.

In European patent application publication No. 0 461 694 to the same Applicant's name, a process is disclosed for deasphalting and demetallating crude oil or a fraction thereof, containing asphaltenes and metals, which process makes it possible the drawbacks which affect the prior art— as mentioned hereinabove, to be at least partially overcome.

More particularly, according to the process disclosed in said European Patent Application No. 0 461 694, a crude oil, or a fraction thereof, is contacted with an organic carbonate, and, in particular, a dialkyl, carbonate, with the process being carried out in a homogeneous liquid phase, until the precipitation is caused of a solid residue, rich with asphaltenes and asphaltenic metals; and said solid residue is separated from the homogeneous liquid phase. After separation of said solid matter, the homogeneous liquid phase can be cooled to cause a refined, oil-rich, liquid phase to separate from an extracted, organic-carbonate-rich, liquid phase. The separation of the extracted and refined liquid phases can be also obtained by adding a liquid solvent which is more polar than said carbonate, with or without cooling.

The present Applicant found now, according to the present invention, that the precipitation of the asphaltenes, and the separation of an extracted liquid phase and of a refined liquid phase can be achieved simultaneously from a solution in dimethyl carbonate of a residue from a crude oil distillation. Such a feature facilitates the continuous operations of the process.

Still according to the invention, the present Applicant also found that, as the extraction solvent, a solution of dimethyl carbonate in an oil solvent can be advantageously used. This feature makes it possible a fraction of the extracted liquid phase, produced during the treatment of the residue from crude oil distillation, to be recycled, thus considerably simplifying, and improving the economy of, said process.

On such a basis, the present invention relates to a continuous, simple and advantageous process for deasphalting and demetallating a residue from a crude oil distillation, by means of dimethyl carbonate as the extraction solvent, which process is characterized in that:

(a) a liquid stream of a residue from crude oil distillation and a recycled liquid stream containing oil and dimethyl carbonate are fed to a mixing means operating at a temperature which is equal to, or higher than, the temperature which enables a homogeneous solution to be obtained;

(b) the stream constituted by the homogeneous solution from step (a) is cooled down to a lower temperature than homogeneity temperature range, and is fed to a decanter means in order to separate a refined light, liquid phase; an extracted, middle liquid phase; and a heavy phase containing the asphaltenes;

(c) the stream constituted by the light liquid phase from step (b) is submitted to treatment in order to separate dimethyl carbonate from a primary, deasphalted and demetallated oil;

(d) the stream constituted by the middle liquid phase from step (b) is partially recycled to the step (a), and the residual portion thereof is submitted to a treatment in order to separate dimethyl carbonate from a secondary deasphalted oil;

(e) the stream constituted by the heavy phase from step (b) is submitted to a treatment for separating the asphaltenes; and (f) the dimethyl carbonate streams separated from the preceding steps are recycled to step (a) and the streams constituted by said asphaltenes and said primary and secondary oils, are recovered.

According to a preferred form of practical embodiment of the present invention, the process is carried out through the following steps:

(a) a liquid stream constituted by a crude oil distillation residue, and a recycled liquid stream containing oil and dimethyl carbonate are fed to a mixing means operating at a temperature higher than approximately 60° C., in order to obtain a homogeneous solution;

(b) the stream constituted by the homogeneous solution from step (a) is cooled down to a temperature lower than 60 ° C. and is fed to a decanter means in order to separate a refined, light liquid phase, an extracted, middle liquid phase and an asphaltene-containing heavy phase;

(c) the stream constituted by the light liquid stream from step (b) is submitted to a treatment in order to separate dimethyl carbonate from a primary deasphalted and demetallated oil;

(d) the stream constituted by the middle liquid phase from step (b) is partially recycled to step (a), the residual portion thereof is mixed with an oil-dimethyl carbonate stream from step (e), and the combined streams are submitted to a treatment in order to separate dimethyl carbonate from a secondary deasphalted oil;

(e) the stream constituted by the heavy phase from step (b) is submitted to a treatment in order to separate the asphaltenes from an oil-dimethyl carbonate stream, which is recycled to step (d); and (f) the dimethyl carbonate streams separated in steps (c), (d) and (e) are recycled to step (a) and the streams constituted by said asphaltenes and said primary and secondary oils are recovered.

The preferred form of practical embodiment of the process of present invention is illustrated now in detail, by referring to the process scheme shown in the FIGURE of the accompanying drawing table.

BRIEF DESCRIPTION OF THE DRAWING

M1 is a mixer stage, possibly of the on-line, static type.

S1 is a three-product streams settler, gravitational or centrifugal. S2 is a combined solids-washing and drying machine consisting of three separate sections. In section I, the solid-rich pulp is mixed with a liquid stream. In section II the washed solid is segregated (e.g., by filtration) from the liquid. In section III, the liquid retained by the wet solid is removed by evaporation. The operations in sections II and III can be assisted by applying a vacuum.

C1 and C2 are stripping columns of standard, perforated or bubble-cup trays and down-comer configuration.

E1 is a sensible heat exchanger which is able to treat solid particles on the shell side. E2 and E4 are sensible heat exchangers. E3, E5, and E6 are total condensers.

The feed (a petroleum distillation residue, 1) and the solvent stream (2, 3 is the solvent make-up) are admixed into M1, forming a solution of oil in solvent. Asphaltenes precipitate under the conditions used which are a temperature (T) above that for complete miscibility and a presume (p) high enough to avoid solvent evaporation). The resulting stream 5 is cooled below T (temperature for complete miscibility) across the exchanger E1 and fed into the separator S1. Three streams are segregated on exit from S1. They are a) an oil-rich (deasphalted oil, DAO1) stream 6, b) a solvent-rich stream 9, and c) an asphaltene-rich stream (16). Oil-rich stream 6 is then heated and the solvent removed (stream 7) from the main product DAO1 (stream 8) in C1. Solvent-rich stream 9 is split into streams 10 (recycle solvent) and 11 and stream 11 is heated and the solvent is recovered and recycled (stream 12). The secondary product oil (DAO2) is removed from the bottom of C2. Asphaltene-rich stream 16 is pumped into the separator S2.

The three sections of the combined solids-washing and drying machine S2 serve the following purposes: in section 1, fresh solvent (condensed vapors 15+18) is used to wash entrained oil off the precipitated asphaltenes; in section II, the oil-insolvent solution is separated and sent to column C2 to recover DAO (stream 17); and in section III, the solvent wetting the solid asphaltenes is stripped by heating, condensed in E6 and recycled to S2 (stream 18). Oil-free, dried, powdery, asphaltenes are discharged from section II of S2 as stream 19.

In this FIGURE, with (M1) a mixing means is indicated, to which a liquid stream (1) constituted by a crude oil distillation residue, is fed. In particular, in the process according to the present invention, the reduced crude oils obtained by atmospheric distillation or by reduced-pressure distillation can be treated, which have a density generally comprised within the range of from about 5 to about 35° API, and a content of asphaltenes which may reach values of the order of 20% by weight.

To the mixing means (M1) also a liquid stream (2) is fed, which is essentially constituted by an oil solution of dimethyl carbonate, with an oil content of from about 3 up to about 10% by weight. Said liquid stream (2) is mainly constituted by the recycle stream (4), and by a minor amount of stream (3) of fresh, make-up dimethyl carbonate. Furthermore, the flow rates of streams (1) and (2) to (M1) are so adjusted, that the weight ratio of dimethyl carbonate to the residue is comprised within the range of from 0.5:1 to 4:1, and preferably of from 2:1 to 4:1. Inside the mixing means (M1), the mixing step is carried out at a temperature higher than about 60° C., and preferably comprised within the range of from 60° to 90° C., and with an optimum value of about 80° C. Under these conditions, and by keeping the contents of the mixing means (M1) suitably stirred, a homogeneous solution is formed after a dwelling time of from 1 to 10 minutes, and typically of the order of from 2 to 5 minutes.

The resulting homogeneous solution is removed from the mixing means (M1) as the liquid stream (5), which is cooled in heat exchanger means (E1) at a temperature lower than 60° C. and preferably comprised within the range of from 20° to 40° C., with the optimum temperature value being of the order of 35° C. The heat exchanger means (E1) may be practically constituted by a cascade of heat exchangers operating in series and fed with process fluids and cooling water. By operating under these conditions, the asphaltenes contained in the solution flocculate with a very fast kinetics, and anyway such that the efficiency of precipitation is largely independent from the contact time.

The stream cooled in (E1) obtained in that way, is sent to the settling tank (S1), within which three phases separate, and namely, a refined light liquid phase, an extracted middle liquid phase, and a heavy phase which contains the asphaltenes.

The light liquid phase contains refined oil and dimethyl carbonate (typically, approximately 30–40% by weight of dimethyl carbonate), and substantially does not contain asphaltenes.

The middle liquid phase contains dimethyl carbonate and extracted oil (typically about 8–20% by weight of extracted oil) and is substantially free from asphaltenes.

The heavy phase, rich in asphaltenes, typically contains 15–25 % by weight of asphaltenes, 45–55% of oil and 25–35% of dimethyl carbonate. This phase separation is very fast and normally occurs in (S1) within a time of the order of a few minutes.

The light liquid phase is removed from the settling tank (S1) as stream (6), is heated in the heat exchanger means (E2) and is submitted to stripping in (C1) tower operating under atmospheric pressure, with a tower head temperature of the order of 90° C. From the head of tower (C1), the vapours of dimethyl carbonate evolve as overhead stream (7), which is condensed in the heat exchanger means (E3) and is recycled, through (4), to the mixing means (M1). Inasmuch as the difference in volatility between the solvent and the oil is very high, a liquid reflux is not required tower (C1), which operates as a half-lower, i.e., only with a stripping zone, and without a rectification zone. From the bottom of tower (C1), a stream (8) of deasphalted/demetallated oil (primary DAO) recovered.

This primary DAO shows an extremely low content of asphaltenes (typically less than about 2% by weight); the deasphalting efficiency is, in any case, better than 90%. The resulting primary DAO is furthermore impoverished (decrease of approximately 60%) of such metals as vanadium and nickel, as well as of sulfur-and nitrogen-containing constituents. Such primary DAO could consequently be used as an additional feedstock to FCC catalytic cracking operations, in mixture with gas oils from vacuum fractionation.

The middle liquid phase, obtained from the settling tank (S1) as stream (9), is partially recycled —as stream (10)—to the mixing means (M1), and a portion thereof is submitted to distillation, as stream (11). The ratio according to which stream (9) is subdivided into streams (10) and (11), is selected on the basis of the balance between the economy of tower (C2), which would lead to reduce to a minimum the stream (11) and the deasphalting efficiency of stream (4), which would lead to reduce stream (10) to a minimum. Even if the fraction which is recycled [stream (10)] may generally be comprised within the range of from 10% to 90% by weight, based on total stream (9), the preferred values are comprised within the range of from 40 to 60% by weight, with 50% by weight being the optimum value.

In practice, the present Applicant was able to observe that good results are obtained when oil concentration in the recycle stream (4) ranges from about 3 to about 10% by weight.

The non-recycled fraction is sent, as stream (11), to the distillation tower (C2), after being preliminarily heated in heat exchanger means (E4). To tower (C2) also a liquid stream (17) is fed, which consists of oil and dimethyl carbonate and comes from the settling tank (S2), as is better disclosed in the following. From tower (C2), operating under atmospheric pressure and at tower head temperatures of the order of 90° C., dimethyl carbonate vapours evolve as stream (12), which is condensed in heat exchanger means (E5). The condensed stream is partially (typically, 50–80%) recycled to the mixing means (M1) as a stream (14), and the residual portion is fed to asphaltenes washing facility (S2), as stream (15), the function of which is explained in the following. At the bottom of the tower (C2) a stream of deasphalted oil (secondary DAO), typically showing a lower average molecular weight than of primary DAO, is recovered; the ratio of secondary DAO to primary DAO is of the order of 0.75–0.80.

The heavy phase is removed from the settling tank (S1) as stream (16), and is sent to unit (S2), normally constituted by a filter, or a centrifuge.

in the preferred form of practical embodiment, a centrifuge is used, in which:

in a first section thereof, the stream (16) is submitted to centrifugation in order to separate most oil and dimethyl carbonate;

in a second section, asphaltenes are submitted to washing with dimethyl carbonate from stream (15), in order to separate residual oil contained in the asphaltenes; the liquid stream obtained from centrifugation and washing recycled to tower (C2) as stream (17); and in a third section, asphaltenes are submitted to drying, and the vapours of dimethyl carbonate which evolve are removed as stream (18), which is recycled to the first zone of the settling tank (S2), after being preliminarily cooled and condensed in heat exchanger means (E6).

By operating under these conditions, from the third zone of (S2) a stream (19) is removed, which is constituted by solid asphaltenes, in powder form. This production of small volumes of asphaltenes instead of considerably large streams of asphalts (as formed in those processes known from the prior art in which paraffinic solvents are used), constitutes a particularly advantageous feature of the process according to the present invention.

In those cases in which the oil retained in the precipitate is not removed to a satisfactory extent by the washing inside the centrifuge, as said hereinabove, one could disperse the precipitate in high-temperature dimethyl carbonate, then cool the dispersion and cause said dispersion to settle. Obviously, such a wash can be repeated a plurality of times until an asphaltic product having the desired characteristics is obtained.

The process according to the present invention is simple and advantageous. In particular, it is carried out at moderate temperatures, with no need for applied overpressure, and with a low ratio of dimethyl carbonate to the crude oil distillation residue submitted to the treatment. Furthermore, said process, besides displaying the typical advantages of a continuous operation, makes it possible high deasphalting efficiency values (higher than 90%) and a high yield (higher than 80%) in deasphalted oil, to be obtained.

The following experimental example reported in order to better illustrate the invention.

EXAMPLE

The feedstock submitted to treatment is the residue from the atmospheric distillation at 370° C. (RA370+) of Egyptian Belaym crude oil (density of crude oil equal to 27.9° API), having the following characteristics:

| | | |
|---|---|---|
| specific gravity (30° C.) | 0.9865 | $kg/dm^3$ |
| kinematic viscosity | | |
| (50° C.) | 2,968 | cS |
| (100° C.) | 117.5 | cS |
| percentage relatively to crude oil | 60.09% | by weight |
| Conradson carbonaceous residue | 13.6% | by weight |
| nickel content | 58 | ppm |
| vanadium content | 108 | ppm |
| sulfur content | 3.31% | by weight |

-continued

| | |
|---|---|
| nitrogen content | 0.26% by weight |
| asphaltene content (insolubles in n-C7, according to IP 143) | 12.0% by weight |
| fractionation by compound class (ASTM D-2007) insolubles in n-C5 | 14.1% by weight |
| saturated components | 31.1% by weight |
| aromatic components | 27.9% by weight |
| polar components | 26.9% by weight |
| average molecular weight (GPC) | 1,210 |

The content of asphaltenes is determined by gravimetric analysis according to ASTM standard D-2007 modified according to IP-143, by operating with a ratio, by weight, of 10 parts of n-heptane to 1 part of sample, and precipitating the asphaltenes during a 2-hour time, under reflux conditions. Vanadium and nickel contents are evaluated by atomic absorption analysis, on samples preliminarily submitted to acidic digestion. The content of vanadium is confirmed by electronic vanadium-(IV) spin resonance spectroscopy. The content of sulfur is evaluated by X-ray fluorescence.

The content of nitrogen is evaluated by the usual Kjeldahl method.

Referring to the FIGURE or the accompanying drawing table, to the mixing means (M1), of 5 liters of capacity, a liquid stream (1) of 187 l/h of RA370+ and a liquid stream (2) of 85 l/h, constituted by the stream (3) of fresh dimethyl carbonate (0.06 kg/h) and the recycled liquid stream (4) containing 90–95% by weight of dimethyl carbonate and 5–10% by weight of oil, are fed.

Inside the mixing means (M1), stirred and thermostatted at about 80° C., a homogeneous solution is formed, with a dwelling time of about 3 minutes.

This solution is removed as stream (5), is cooled in the heat exchanger means (E1) down to about 35° C., and is sent to the settling tank (S1), in which a refined light liquid phase, an extracted middle liquid phase and a heavy, asphaltene-containing phase are separated.

The light liquid phase (essentially constituted by oil and dimethyl carbonate, with approximately 34% of the latter) is removed from the settling tank (S1) as stream (6), with a flow rate of about 119 l/h, is heated in heat exchanger means (E2) and is submitted to stripping in tower (C1), operating under atmospheric pressure, and with a head temperature of about 90° C.

From the top of the tower (C1), the vapours of dimethyl carbonate evolve as stream (7), said vapours are condensed in heat exchanger means (E3), and the stream is recycled to the mixing means (M1). From the bottom of the tower (C1), a stream (8) of 78 l/h of primary deasphalted/demetallated oil (primary DAO) is recovered.

Primary DAO displays a content of asphaltenes of 1.14%, and therefore the deasphalting efficiency results to be of 91. Its average molecular weight is comparable the molecular weight of feedstock. Furthermore, said primary DAO contains 22 ppm of nickel, 44 ppm of vanadium, 1.75% of sulfur and 0.11% of nitrogen. Therefore, the efficiency of removal of (nickel+vanadium) results to be of 60%, and the efficiency of removal of (sulfur+nitrogen) results to be of 52%.

The middle liquid phase (essentially consisting of dimethyl carbonate and oil, with approximately 9.8% of oil), is collected from the settling tank (S1) as stream (9), with a flow rate of about 818 l/h; a portion thereof (about 50% by weight) is recycled as stream (10) to the mixing means (M1), and the residual portion thereof is submitted to distillation in column (C2), after being preliminarily heated in heat exchanger means (E4). To tower (C2), also a liquid stream (17) consisting of oil and dimethyl carbonate is fed, which comes from the zone of asphaltenic precipitate conditioning (S2).

From tower (C2), operating under atmospheric pressure and with a head temperature of about 90° C., the vapours of dimethyl carbonate evolve as stream (12) and are condensed in heat exchanger means (E5). The condensate stream is partially (about 70%) recycled to the mixing means (M1) as stream and the residual portion is fed to the washing zone in (S2), as stream (15). From the bottom of tower (C2), a stream of secondary deasphalted oil (secondary DAO) is recovered, with a flow rate of about 87 l/h.

This secondary DAO has an average molecular weight of about 610, a nickel content of 5 ppm and a vanadium content of 11 ppm, and therefore the efficiency of removal of (nickel+vanadium) is of 90%.

The total efficiency of removal of (nickel+-vanadium) is hence of 76.5%.

The heavy phase (containing, on an average, 48% of oil, 30% of dimethyl carbonate and 22% of asphaltenic solids) is removed from the settling tank (S1) as stream (16), with a flow rate of about 102 l/h, and is sent to the centrifuge (S2).

In the first zone of (S2), the stream (16) is submitted to centrifugation, in order to separate a stream of oil and dimethyl carbonate.

In the second zone of (S2), the asphaltenes are submitted to high-temperature washing with dimethyl carbonate distilled off from stream (15), combined with dimethyl carbonate recovered from stream (18), in order to separate any residual oil.

The liquid stream obtained from centrifugation and washing is recycled to tower (C2) as stream (17).

In the third zone of (S2), asphaltenes are submitted to drying, and the vapours of dimethyl carbonate which evolve are removed as stream (18), which is recycled to the second zone of (S2), after being preliminarily cooled and condensed in heat exchanger means (E6).

In the third zone of (S2), a solid stream (19), which is constituted is by precipitated asphaltenes, is discharged at a flow rate of approximately 22 kg/h.

These solid materials have a heat value comparable to insolubles in n-C7, and the following composition, evaluated by elemental analysis under oxygen flow:

| Analysis | Insolubles in dimethyl carbonate | Insolubles in n-C7 |
|---|---|---|
| C (% by weight) | 82.67 | 84.70 |
| H (% by weight) | 9.97 | 7.72 |
| S (% by weight) | 5.32 | 4.98 |
| N (% by weight) | 1.52 | 2.13 |
| Ashes (% by weight) | 0.2 | 0.2 |
| O (% by weight) (by difference) | 0.31 | 0.42 |
| Heat value (kcal/kg | | |
| high heat value | 9733 | 9648 |
| net heat value | 9219 | 9250 |
| C/H ratio (computed value) | 8,29/1 | 10.97/1 |

We claim:

1. A continuous process for deasphalting and demetallating a residue, from a crude oil distillation, containing asphaltenes in an amount up to 20% by weight, which comprises the steps of:

(a) feeding a liquid stream of the residue from the crude oil distillation, the stream having an API oil gravity of about 5° to 35°, and a recycled liquid stream consisting essentially of dimethyl carbonate and optionally oil up to 10% by weight to a mixing means operating at a temperature higher than about 60° C. in order to form a homogeneous solution;

(b) cooling the homogeneous solution from step (a) to a temperature lower than about 60° C. so that phase separation occurs;

(c) feeding the cooled solution from step (b) to a decanter means in order to separate a refined light liquid phase, an extracted middle liquid phase, and a heavy liquid phase consisting essentially of the asphaltenes;

(d) submitting the light liquid phase from step (c) to a treatment in order to separate the dimethyl carbonate from a primary deasphalted and demetallated oil;

(e) partially recycling to step (a) the middle liquid phase from step (c) which phase consists essentially of dimethyl carbonate and a secondary deasphalted oil, the residual portion thereof being submitted to a treatment in order to separate dimethyl carbonate from the secondary deasphalted and demetallated oil;

(f) submitting the heavy liquid phase from step (c) to a treatment for separating the asphaltenes;

(g) recycling the dimethyl carbonate streams separated in the preceding steps to step (a); and (h) recovering the streams consisting essentially of the asphaltenes and the primary and secondary deasphalted oils.

2. A process according to claim 1, wherein the liquid stream recycled to step (a) is a mixture of oil and dimethyl carbonate, said mixture having an oil content of from 3 to about 10% by weight.

3. A process according to claim 1, wherein step (a) is carried out with stirring at a weight ratio of dimethyl carbonate to residue within the range from 0.5:1 to 4:1.

4. A process according to claim 3, wherein step (a) is carried out with stirring at a weight ratio of dimethyl carbonate to residue within the range from 2:1 to 4:1.

5. A process according to claim 1, wherein in step (b) the homogeneous solution from step (a) is cooled to a temperature of from 20° to 40° C. and is sent to a settling tank for a time sufficient for the phase separation to occur.

6. A process according to claim 5, wherein in step (b) the homogeneous solution from step (a) is cooled to a temperature of about 35° C. and is sent to a settling tank for a time sufficient for the phase separation to occur.

7. A process according to claim 1, wherein in step (d) the primary deasphalted and demetallated oil is separated from the light liquid phase by means of a dimethyl carbonate stripping.

8. A process according to claim 1, wherein in step (e) an amount of from to 10 to 90% by weight of the middle liquid phase is recycled to step (a).

9. A process according to claim 8, wherein in step (e) an amount of from 40 to 60% by weight of the middle liquid phase is recycled to step (a).

10. A process according to claim 9, wherein in step (e) an amount of about 50% by weight of the middle liquid phase is recycled to step (a).

11. A process according to claim 1, wherein step (f) is carried out in a centrifuge, wherein in a first section thereof, the heavy phase from step (c) is centrifuged in order to separate most of the oil and dimethyl carbonate;

in a second section thereof, the asphaltenes are washed with dimethyl carbonate; and in a third section, the asphaltenes are dried.

* * * * *